US007898488B2

(12) United States Patent
Takemura et al.

(10) Patent No.: US 7,898,488 B2
(45) Date of Patent: Mar. 1, 2011

(54) ANTENNA APPARATUS

(75) Inventors: Nobuyasu Takemura, Tokyo (JP); Masataka Ohtsuka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 581 days.

(21) Appl. No.: 11/970,636

(22) Filed: Jan. 8, 2008

(65) Prior Publication Data

US 2008/0169991 A1 Jul. 17, 2008

(30) Foreign Application Priority Data

Jan. 12, 2007 (JP) ..... 2007-004706

(51) Int. Cl.
*H01Q 11/12* (2006.01)

(52) U.S. Cl. ..... 343/741

(58) Field of Classification Search ..... 343/741, 343/742, 702

See application file for complete search history.

(56) References Cited

U.S. PATENT DOCUMENTS 5,402,134 A * 3/1995 Miller et al. ..... 343/742
6,486,844 B2 * 11/2002 Thursby et al. ..... 343/744
7,286,098 B2 * 10/2007 Ogino et al. ..... 343/833
2002/0024472 A1 * 2/2002 Thursby et al. ..... 343/741
2007/0177414 A1 * 8/2007 Funato et al. ..... 365/36

FOREIGN PATENT DOCUMENTS

JP 09-148838 A 6/1997
JP 2003-008326 A 1/2003

* cited by examiner

*Primary Examiner*—Huedung Mancuso
(74) *Attorney, Agent, or Firm*—Sughrue Mion, PLLC

(57) ABSTRACT

A ground conductor constituting a bottom board and a loop antenna formed of a strip conductor formed separately from and around the ground conductor are provided on one face of a dielectric substrate, and a transmitter-receiver is connected to one end of the loop antenna serving as the power dispatching unit via a first matching circuit, and a second matching circuit is connected to the other end. A conductor formed of the strip conductor is provided on the dielectric substrate on the other face of the dielectric substrate so as to oppose the loop antenna with the intermediary of the dielectric substrate. A third matching circuit is connected to one end of the conductor and a fourth matching circuit is connected to the other end of the conductor. The loop antenna and the conductor are set to have a wavelength shorter than that of the frequency band to be used.

16 Claims, 7 Drawing Sheets

(FRONT FACE OF SUBSTRATE)

(BACK FACE OF SUBSTRATE)

(FRONT FACE OF SUBSTRATE)

(BACK FACE OF SUBSTRATE)

CONNECTION DIAGRAM
(FRONT FACE OF SUBSTRATE)

CONNECTION DIAGRAM
(BACK FACE OF SUBSTRATE)

IMPEDANCE CHARACTERISTICS

REFLECTION CHARACTERISTICS (FRONT FACE OF SUBSTRATE)

(BACK FACE OF SUBSTRATE)

CONNECTION DIAGRAM
(FRONT FACE OF SUBSTRATE)

CONNECTION DIAGRAM
(BACK FACE OF SUBSTRATE)

IMPEDANCE CHARACTERISTICS

REFLECTION CHARACTERISTICS

SCHEMATIC BLOCK DIAGRAM
(FRONT FACE OF LAMINATED SUBSTRATE)

SCHEMATIC BLOCK DIAGRAM
(BACK FACE OF LAMINATED SUBSTRATE)

SCHEMATIC BLOCK DIAGRAM
(CROSS SECTION OF LAMINATED SUBSTRATE)

IMPEDANCE CHARACTERISTICS

REFLECTION CHARACTERISTICS

ANTENNA APPARATUS

BACKGROUND OF THE INVENTION

1. Field of the Invention

The present invention relates to an antenna apparatus used mainly for radio apparatus for a portable device such as a smart keyless entry system.

2. Description of the Related Art

An antenna apparatus in the related art is configured as shown in FIG. 6 which illustrates a schematic configuration and a connecting state. Reference numeral 1 designates a loop antenna, reference numeral 3 designates a ground conductor, reference numeral 4 designates a dielectric substrate, reference numeral 5 designates a transmitter-receiver, reference numeral 6 designates a first matching circuit and reference numeral 7 designates a second matching circuit.

Operation of the antenna apparatus in the related art will now be described.

The ground conductor 3 is formed on the front face of the dielectric substrate 4. Impedance of the loop antenna 1 provided around the ground conductor 3 is adjusted by the first matching circuit 6 connected to one of power dispatching units of the loop antenna 1 and the second matching circuit 7 connected to other portion of the loop antenna 1 so as to be operated in a frequency band to be used. The transmitter-receiver 5 is connected to the loop antenna 1 whose impedance is adjusted, and signals are transmitted and received by the transmitter-receiver 5 (for example, JP-A-2003-8326)

An example of impedance characteristics and reflection characteristics of the power dispatching unit of the loop antenna 1 in the related art are shown in FIGS. 7A and 7B. In FIGS. 7A and 7B, reference numeral 10 designates an impedance characteristic, and reference numeral 11 is a circle showing Voltage Standing Wave Ratio (VSWR)=2. The impedance characteristic 10 of the power dispatching unit of the loop antenna 1 is such that the frequency band width is narrow when VSWR≦2, so that sufficient performance cannot be obtained.

The antenna apparatus of this type is required to be compact considering convenience of portability. However, the antenna apparatus in the related art has a structure which is difficult to secure a sufficient antenna length in a compact size. Since the length of the antenna is limited, there arises a problem that it is difficult to widen the frequency band to be used.

SUMMARY OF THE INVENTION

In order to solve the above-described problem, it is an object of the invention to provide an antenna apparatus in which the frequency band to be used is able to be widened with little increase in capacity of the antenna in the related art.

An antenna apparatus is configured as follows. A ground conductor which constitutes a bottom board is formed on a first face, which is one face of a dielectric substrate, a loop antenna having matching circuits connected respectively to both ends thereof and having a wavelength shorter than that of a frequency band to be used is provided in the vicinity of the circumference of the ground conductor, signals are transmitted and received by a power dispatching unit formed at one end of the matching circuit, and a conductor having matching circuits connected respectively to both ends thereof and having a wavelength shorter than that of the frequency band to be used is provided on a second face, which is the other face of the dielectric substrate with the intermediary of the dielectric substrate, so as to be electromagnetically coupled and resonant with the loop antenna.

Accordingly, an antenna apparatus in which the frequency band to be used is able to be widened with little increase in capacity of the antenna in comparison with the antenna apparatus of this type in the related art.

The foregoing and other object, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1A:
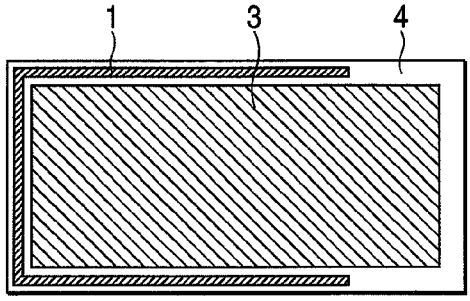
FIGS. 1A and 1B are explanatory drawings showing a configuration of an antenna apparatus according to a first embodiment of the invention.
Figure 1A:
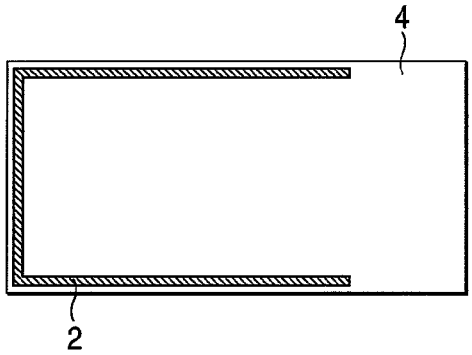
Figure 1B:
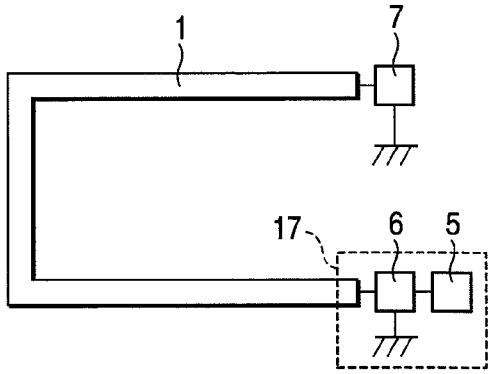
Figure 1B:
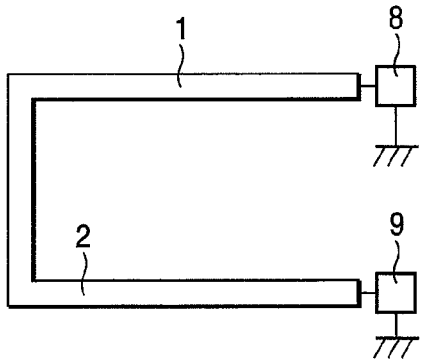

FIGS. 1A and 1B are explanatory drawings showing a configuration of an antenna apparatus according to a first embodiment of the invention. In FIG. 1, reference numeral 1 designates a loop antenna, reference numeral 2 designates a conductor, reference numeral 3 designates a ground conductor, reference numeral 4 designates a dielectric substrate, reference numeral 5 designates a transmitter-receiver, reference numeral 6 designates a first matching circuit, reference numeral 7 designates a second matching circuit, reference numeral 8 designates a third matching circuit, reference numeral 9 designates a fourth matching circuit, and reference numeral 17 designates a power dispatching unit of the loop antenna 1. FIG. 1A is an explanatory drawing illustrating a state of formation of the loop antenna 1, the ground conductor 3 and the conductor 2 on a front face and a back face of the dielectric substrate 4, and FIG. 1B is an explanatory drawing illustrating a connecting state of the first matching circuit 6, the second matching circuit 7, the third matching circuit 8, the fourth matching circuit 9 and the transmitter-receiver 5 with respect to the loop antenna 1 and the conductor 2. In the first embodiment, a case in which the ground conductor 3 is formed on one face of the dielectric substrate 4 which is the face where the loop antenna 1 is formed, and the loop antenna 1 and the conductor 2 are formed on the dielectric substrate 4 as strip conductors will be described as an example. The ground conductor 3 which constitutes a bottom board of the loop antenna 1 and the loop antenna 1 formed of a strip conductor formed around the ground conductor 3 separately therefrom are provided on one face of the dielectric substrate 4. The transmitter-receiver 5 is connected to one end which corresponds to the power dispatching unit 17 of the loop antenna 1 via the first matching circuit 6, and the second matching circuit 7 is connected to the other end of the loop antenna 1. The conductor 2 formed on the dielectric substrate 4 of a strip conductor is provided on the other face of the dielectric substrate 4 so as to oppose the loop antenna 1 with the intermediary of the dielectric substrate 4. The third matching circuit 8 is connected to one of the conductor 2, and the fourth matching circuit 9 is connected to the other end of the conductor 2. Here, the loop antenna 1 and the conductor 2 respectively have the matching circuits at the both ends thereof, so that the wavelength thereof are shorter than that of the frequency band to be used.

Subsequently, operation of the antenna apparatus according to the first embodiment will be described.

In the antenna apparatus, the impedance of the power dispatching unit 17 of the loop antenna 1 is adjusted by the first matching circuit 6 and the second matching circuit 7 so as to be operated in the frequency band to be used. The impedance of the power dispatching unit 17 of the loop antenna 1 is also adjusted by the third matching circuit 8 and the fourth matching circuit 9 so as to be operated in the frequency band to be used.

In other words, the resonance frequencies of the loop antenna 1 and the conductor 2 are substantially equalized by the first matching circuit 6, the second matching circuit 7, the third matching circuit 8 and the fourth matching circuit 9 connected respectively to the loop antenna 1 and the conductor 2, so that the impedance of the power dispatching unit 17 of the loop antenna 1 is adjusted to be operated in the frequency band to be used.

In this manner, according to the antenna apparatus in the invention, signals are transmitted and received by the transmitter-receiver 5 connected to the loop antenna 1 in which the impedance of the power dispatching unit 17 is adjusted.

Figure 2A:
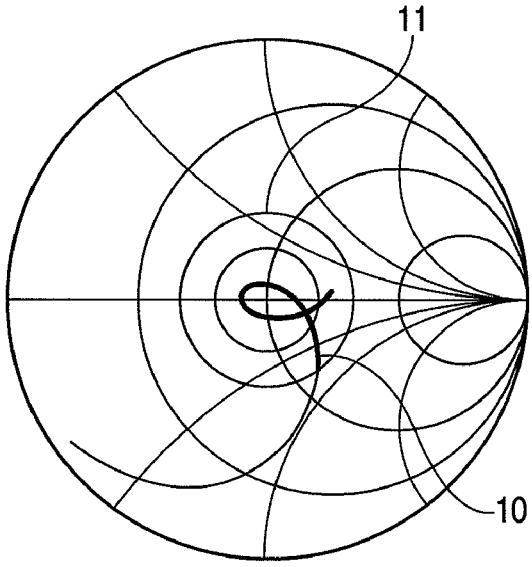
FIGS. 2A and 2B are explanatory drawings illustrating examples of impedance characteristics and reflection characteristics in a power dispatching unit of the antenna apparatus according to the invention.
Figure 2B:
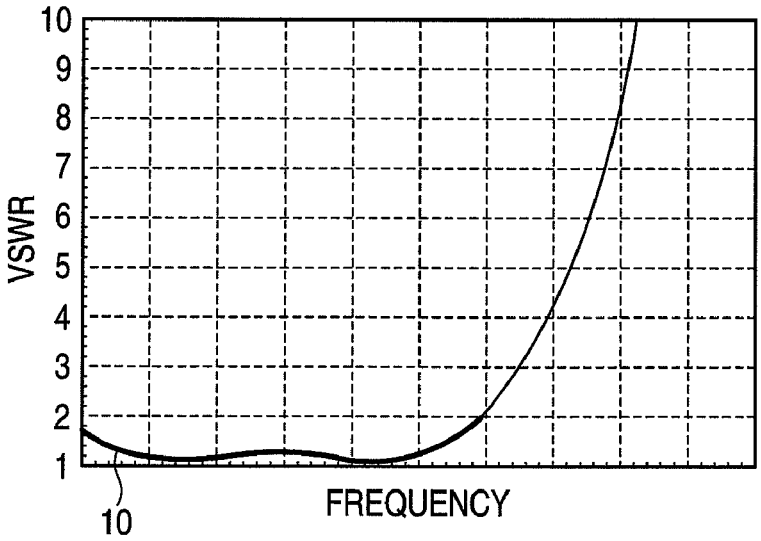

FIGS. 2A and 2B are explanatory drawings illustrating examples of impedance characteristics and reflection characteristics in the power dispatching unit 17 of the loop antenna 1 in the antenna apparatus according to the invention. In these drawings, reference numeral 10 designates an impedance characteristic, and reference numeral 11 designates a circle showing VSWR=2, and dual resonant characteristic is demonstrated as the reflection characteristic.

Therefore, from FIGS. 2A and 2B, it is understood that the impedance characteristic 10 in the power dispatching unit 17 of the loop antenna 1 has a characteristic such that the frequency band within the circle 11 showing VSWR=2, that is, the frequency band of VSWR≦2 is wide and demonstrates a wide-band characteristic.

As described above, according to the antenna apparatus in the first embodiment, the loop antenna 1 and the conductor 2 are formed on the front face and the back face of the dielectric substrate 4 so as to oppose to each other, the impedance of the power dispatching unit 17 of the loop antenna 1 is adjusted by the first matching circuit 6 and the second matching circuit 7 so as to be operated in the frequency band to be used, and the impedance of the power dispatching unit 17 of the loop antenna 1 is adjusted by the third matching circuit 8 and the fourth matching circuit 9 so as to be operated in the frequency band to be used. Since the impedance is adjustable as desired, the respective resonance frequencies of the loop antenna 1 and the conductor 2 are substantially equalized and the loop antenna 1 and the conductor 2 are electromagnetically coupled. Therefore, dual resonance characteristic is obtained, and hence wide-band is achieved in a predetermined frequency band to be used.

Therefore, according to the antenna apparatus in the first embodiment, since the conductor 2, third matching circuit 8 and the fourth matching circuit 9 are arranged on the back face of the dielectric substrate 4, which is formed with the loop antenna 1, the first matching circuit 6 and the second matching circuit 7 on the front face thereof, so as to oppose the loop antenna 1 to achieve electromagnetic coupling, the widening of the band width is achieved in the predetermined frequency band to be used with little increase in capacity of the antenna in comparison with the case in which only the loop antenna 1 is formed, so that the antenna apparatus which is compact and is capable of widening the frequency band to be used is achieved.

The shape of the ground conductor 3 and the loop antenna 1 to be formed on the dielectric substrate 4 is not limited to the rectangular shape as long as it is designed to function as an antenna with the ground conductor 3 as the bottom board as needed. The loop antenna 1 and the conductor 2 are not limited to be the strip conductor. The ground conductor 3 may include a circuit component such as a chip component mounted thereto. The ground conductor 3 may be formed on both faces of the dielectric substrate 4 so as to have the same potential as long as it is formed at least one of the faces thereof.

Second Embodiment

Figure 3A:
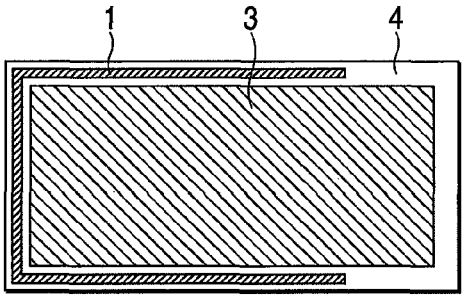
FIGS. 3A and 3B are explanatory drawings showing a configuration of the antenna apparatus according to a second embodiment of the invention.
Figure 3A:
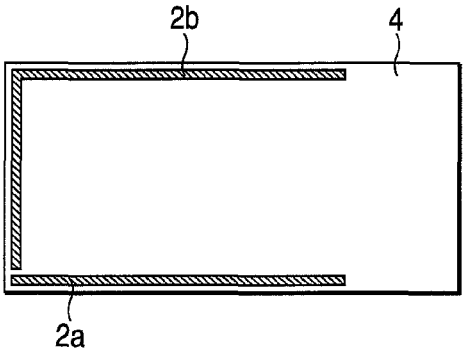
Figure 3B:
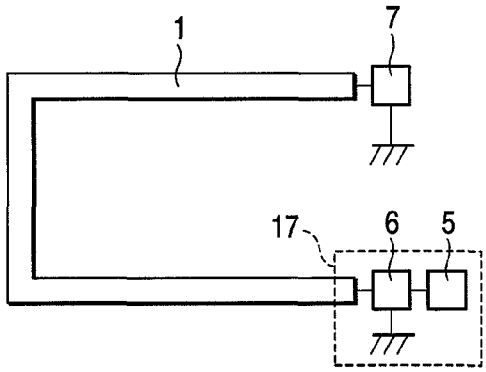
Figure 3B:
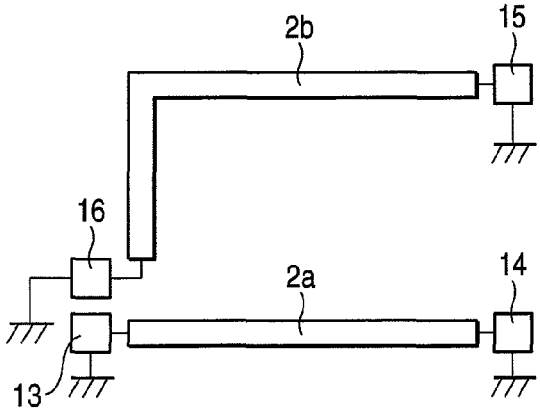

FIGS. 3A and 3B are explanatory drawings showing a configuration of the antenna apparatus according to a second embodiment of the invention. In these drawings, reference numeral 1 designates the loop antenna, reference numeral 2*a* designates a first conductor, reference numeral 2*b* designates a second conductor, reference numeral 3 designates the ground conductor, reference numeral 4 designates the dielectric substrate, reference numeral 5 designates the transmitter-receiver, reference numeral 6 designates the first matching circuit, reference numeral 7 designates a second matching circuit, reference numeral 13 designates a fifth matching circuit, reference numeral 14 designates a sixth matching circuit, reference numeral 15 designates a seventh matching circuit and reference numeral 16 designates an eighth matching circuit. FIG. 3A is an explanatory drawing illustrating a state of formation of the loop antenna 1 and the ground conductor 3, and the first and the second conductors 2*a* and 2*b* respectively on the front and back faces of the dielectric substrate 4, and FIG. 3B is an explanatory drawing illustrating a connecting state of the first matching circuit 6, the second matching circuit 7 and the transmitter-receiver 5 with respect to the loop antenna 1, and a connecting state of the fifth matching circuit 13, the sixth matching circuit 14, the seventh matching circuit 15 and the eighth matching circuit 16 with respect to the first conductor 2*a* and the second conductor 2*b*. In the second embodiment, a case in which the ground conductor 3 which forms the bottom board of the loop antenna 1 is formed on one face of the dielectric substrate 4 which is the face where the loop antenna 1 is formed, and the loop antenna 1 and the first conductor 2*a* and the second conductor 2*b* are formed on the dielectric substrate 4 as strip conductors will be described as an example. The ground conductor 3 and the loop antenna 1 formed of a strip conductor and formed around the ground conductor 3 separately therefrom are provided on one surface of the dielectric substrate 4. The transmitter-receiver 5 is connected to one end of the loop antenna 1 which corresponds to the power dispatching unit 17 via the first matching circuit 6 and the second matching circuit 7 is connected to the other end of the loop antenna 1.

A strip conductor formed on the dielectric substrate 4 so as to oppose the loop antenna 1 with the intermediary of the dielectric substrate 4 and divided into the first conductor 2*a* and the second conductor 2*b* is provided on the other face of the dielectric substrate 4. The fifth matching circuit 13 is connected to one end of the first conductor 2*a*, the sixth matching circuit 14 is connected to the other end of the first conductor 2*a*, the seventh matching circuit 15 is connected to one end of the second conductor 2*b* and the eighth matching circuit 16 is connected to the other end of the second conductor 2*b*. The loop antenna 1, the first conductor 2*a* and the second conductor 2*b* each include matching circuits connected to both ends thereof, so that the wavelength is shorter than that of the frequency band to be used.

Subsequently, operation of the antenna apparatus according to the second embodiment will be described.

In the antenna apparatus, the impedance of the power dispatching unit 17 of the loop antenna 1 is adjusted by the first matching circuit 6 and the second matching circuit 7 so as to be operated in the frequency band to be used. The impedance of the power dispatching unit 17 of the loop antenna 1 is also adjusted by the fifth matching circuit 13 and the sixth matching circuit 14 so as to be operated in the frequency band to be used. The impedance of the power dispatching unit 17 of the loop antenna 1 is also adjusted by the seventh matching circuit 15 and the eighth matching circuit 16 so as to be operated in the frequency band to be used.

In other words, the resonance frequencies of the loop antenna 1 and the first conductor 2*a* and the second conductor 2*b* are substantially equalized by the first matching circuit 6, the second matching circuit 7, the fifth matching circuit 13, the sixth matching circuit 14, the seventh matching circuit 15 and the eighth matching circuit 16 connected to the loop antenna 1 and the first and second conductors 2*a* and 2*b* respectively, so that the impedance of the power dispatching unit 17 of the loop antenna 1 is adjusted to be operated in the frequency band to be used.

In this manner, according to the antenna apparatus in the invention, signals are transmitted and received by the transmitter-receiver 5 connected to the loop antenna 1 in which the impedance of the power dispatching unit 17 is adjusted.

Figure 4A:
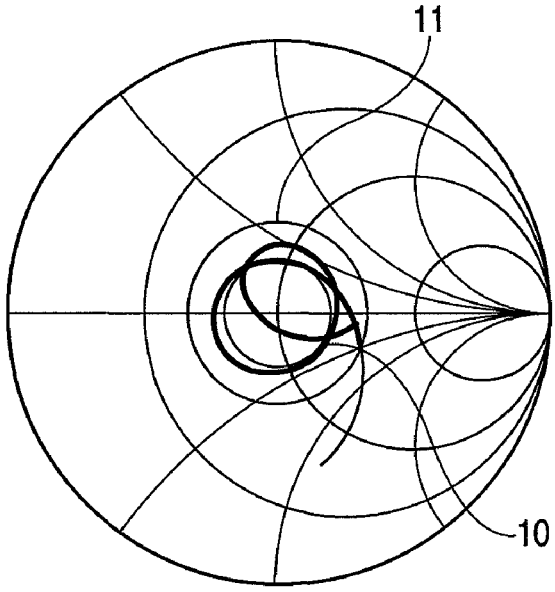
FIGS. 4A and 4B are explanatory drawings illustrating examples of impedance characteristics and reflection characteristics in the power dispatching unit of the antenna apparatus according to the invention.
Figure 4B:
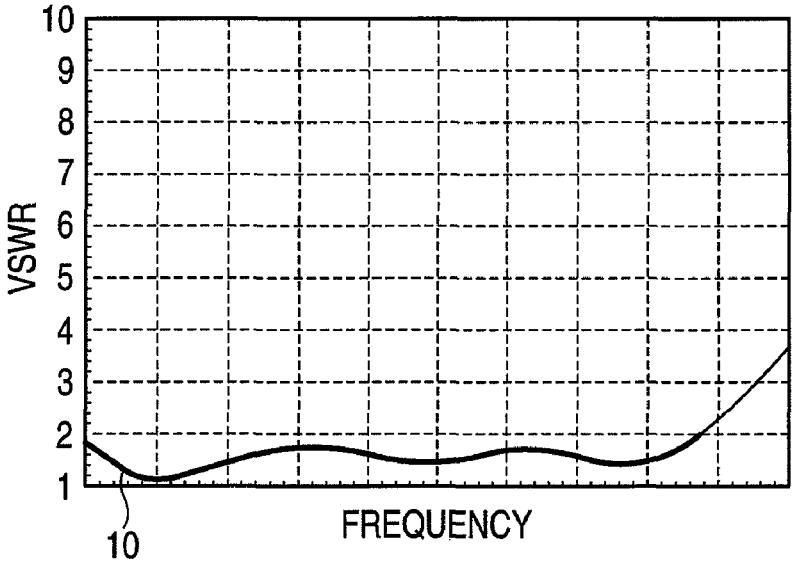

FIGS. 4A and 4B are explanatory drawings illustrating examples of impedance characteristics and reflection characteristics in the power dispatching unit 17 of the loop antenna 1 in the antenna apparatus according to the invention. In these drawings, reference numeral 10 designates the impedance characteristic, and reference numeral 11 designates the circle showing VSWR=2.

Therefore, from FIGS. 4A and 4B, it is understood that the impedance characteristic 10 in the power dispatching unit 17 of the loop antenna 1 has a characteristic such that the frequency band within the circle 11 showing VSWR=2, that is, the frequency band of VSWR≦2 is wide and demonstrates a wide-band characteristic.

As described above, according to the antenna apparatus in the second embodiment, the loop antenna 1 and the first and second conductors 2*a* and 2*b* are formed on the front face and the back face of the dielectric substrate 4 respectively so as to oppose to each other, the impedance of the loop antenna 1 at the power dispatching unit 17 of the loop antenna 1 is adjusted by the first matching circuit 6 and the second matching circuit 7 so as to be operated in the frequency band to be used, and the impedance of the loop antenna 1 at the power dispatching unit 17 of the loop antenna 1 is adjusted by the fifth matching circuit 13, the sixth matching circuit 14, the seventh matching circuit 15 and the eighth matching circuit 16 so as to be operated in the frequency band to be used. Since the impedance is adjustable as desired, the respective resonance frequencies of the loop antenna 1 and the first and second conductors 2*a* and 2*b* are substantially equalized and the loop antenna 1 and the first and second conductors 2*a* and 2*b* are electromagnetically coupled. Therefore, triple resonance characteristic is obtained, and hence wide-band is achieved in a predetermined frequency band to be used.

With the antenna apparatus according to the second embodiment, the flexibility of the impedance adjustment is increased in comparison with the case of the first embodiment.

Therefore, according to the antenna apparatus in the second embodiment, since the first conductor 2*a* and second conductor 2*b*, the fifth matching circuit 13, the sixth matching circuit 14, the seventh matching circuit 15 and the eighth matching circuit 16 are arranged on the back face of the dielectric substrate 4 which is formed with the loop antenna 1, the first matching circuit 6 and the second matching circuit 7 on the front face thereof, so as to oppose the loop antenna 1 to achieve electromagnetic coupling, the widening of the band width is achieved in the predetermined frequency band to be used with little increase in capacity of the antenna in comparison with the case in which only the loop antenna 1 is formed, so that the antenna apparatus which is compact and is capable of widening the frequency band to be used is achieved.

The shape of the ground conductor 3 and the loop antenna 1 to be formed on the dielectric substrate 4 is not limited to the rectangular shape as long as it is designed to function as an antenna with the ground conductor 3 as the bottom board as needed.

The loop antenna 1 and the first conductor 2*a* and the second conductor 2*b* are not limited to be the strip conductor.

The ground conductor 3 may include a circuit component such as a chip component mounted thereto.

The ground conductor 3 may be formed on both faces of the dielectric substrate 4 so as to have the same potential as long as it is formed at least one of the faces thereof.

Furthermore, the strip conductor opposing the loop antenna 1 with the intermediary of the dielectric substrate 4 has been described by exemplifying the case of being divided into the first conductor 2*a* and the second conductor 2*b*. However, the invention is not limited thereto, and it may be divided into a plurality of parts.

Third Embodiment

The antenna apparatus according to a third embodiment of the invention has the configuration shown in FIGS. 1A and 1B described in conjunction with the first embodiment and a terminating resistance is provided at one of the matching circuits connected respectively to the ends of the conductor 2 (not shown). The antenna apparatus according to the third embodiment of the invention has the configuration shown in FIGS. 3A and 3B described in conjunction with the second embodiment and a terminating resistance is provided at one of the matching circuits connected respectively to the ends of the first conductor 2*a* and the second conductor 2*b* (not shown).

In this configuration, with the antenna apparatus according to the third embodiment, the flexibility of adjustment when adjusting the impedance of the antenna apparatus at the power dispatching unit 17 of the loop antenna 1 may be increased, so that widening of the frequency band to be used is easily achieved.

Therefore, according to the antenna apparatus in the third embodiment, the antenna apparatus which is easy to adjust at the time of manufacture and is capable of widening the frequency band to be used is achieved.

Fourth Embodiment

When mounting a circuit component such as a chip component on a face of the dielectric substrate 4 opposite from the face on which the loop antenna is provided in the configurations shown in FIGS. 1A and 1B and FIGS. 3A and 3B described in conjunction with the first and second embodiments, or the configuration described in conjunction with the third embodiment, the circuit component mounted to the dielectric substrate 4 affects the antenna characteristics. Therefore, when mounting the circuit components or the like on the dielectric substrate 4, the antenna apparatus according to a fourth embodiment of the invention is configured in such a manner that a second ground conductor on which the circuit component is mounted is formed on the face of the dielectric substrate 4 opposing the ground conductor 3, and the ground conductor 3 and the second ground conductor formed on one surface of the dielectric substrate 4 are connected in conduction via a through hole, so that the affect of the mounted circuit or the like to the antenna characteristics is reduced (not shown).

In this configuration, the antenna apparatus according to the fourth embodiment, the mounting efficiency is improved, and the antenna apparatus which is compact and is capable of widening the frequency band to be used is achieved.

Fifth Embodiment

Subsequently, a fifth embodiment will be described. In the antenna apparatus exemplified in the first to fourth embodiments, the components such as the ground conductor 3, the loop antenna 1, the conductor 2 or the first conductor 2*a* and the second conductor 2*b* are formed on each layer of the laminated dielectric substrates. For example, a case in which the configuration of the fifth embodiment is applied to the first embodiment is shown as an example in FIGS. 5A, 5B and 5C and will be described below.

Figure 5A:
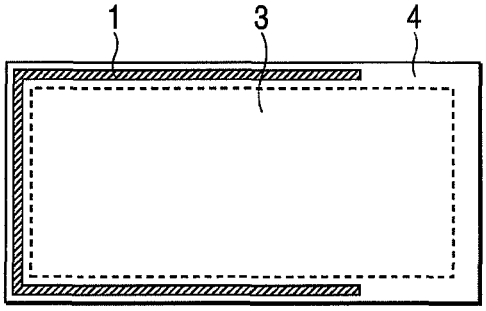
FIGS. 5A, 5B and 5C are explanatory drawings showing a configuration of the antenna apparatus according to a fifth embodiment of the invention.
Figure 5B:
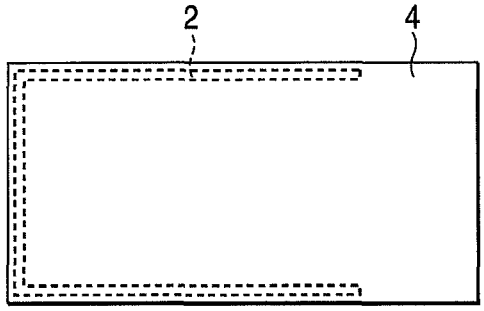
Figure 5C:
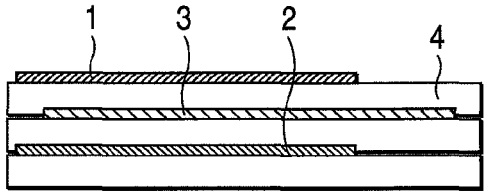
Figure 6:
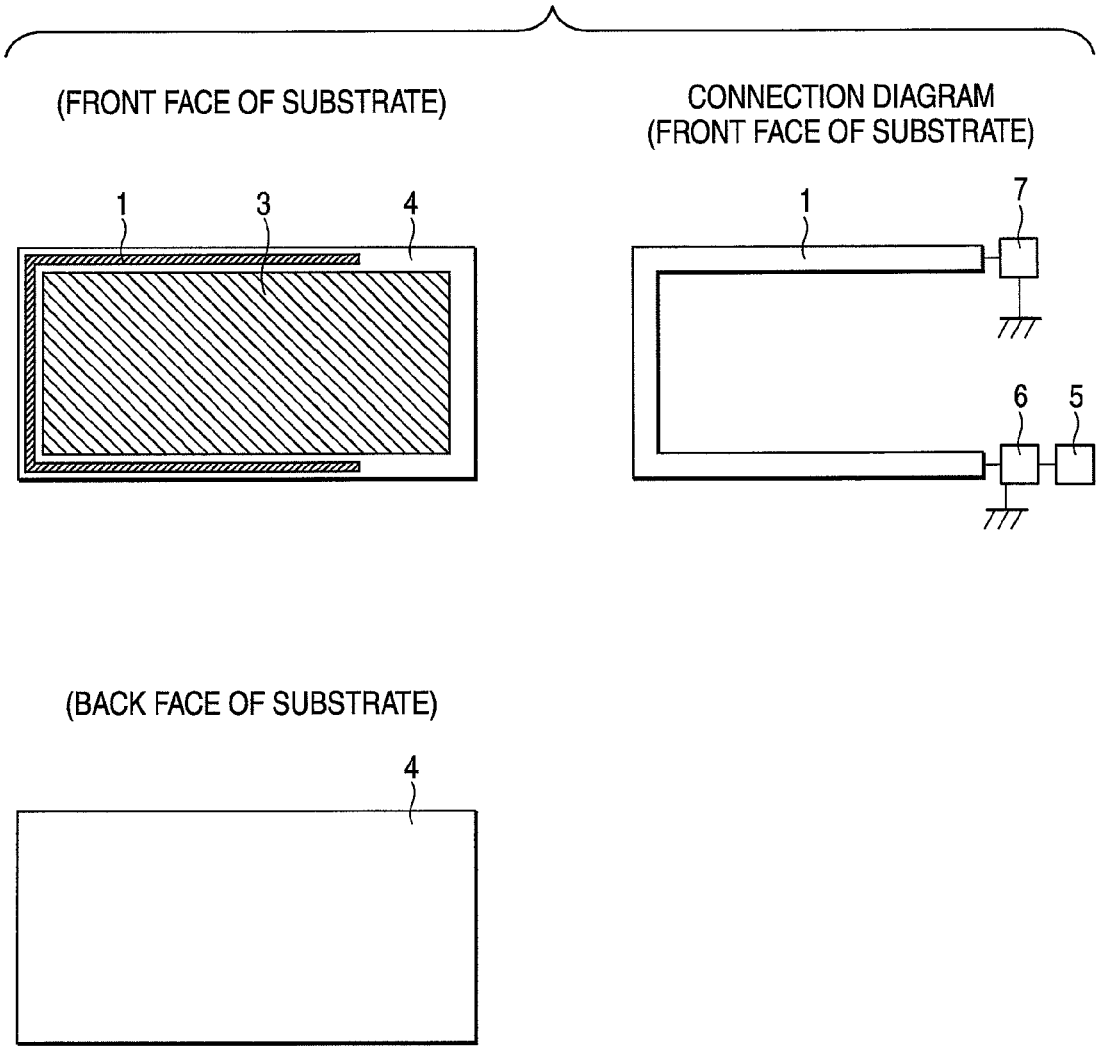
FIG. 6 illustrates a schematic configuration and a connecting state of an antenna apparatus in the related art.
Figure 7A:
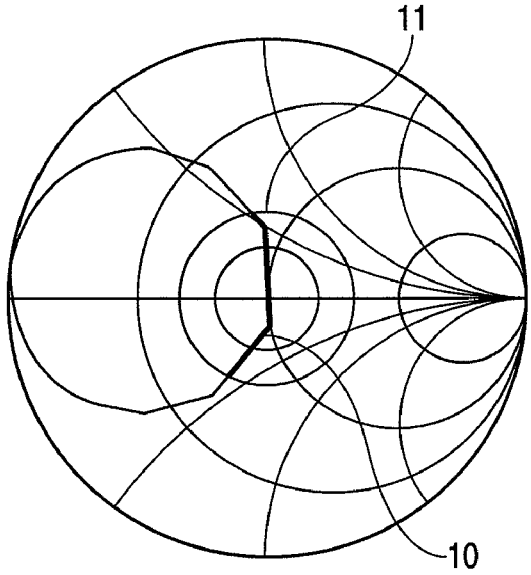
FIGS. 7A and 7B are explanatory drawings illustrating examples of impedance characteristics and reflection characteristics in the power dispatching unit in the antenna apparatus in the related art.
Figure 7B:
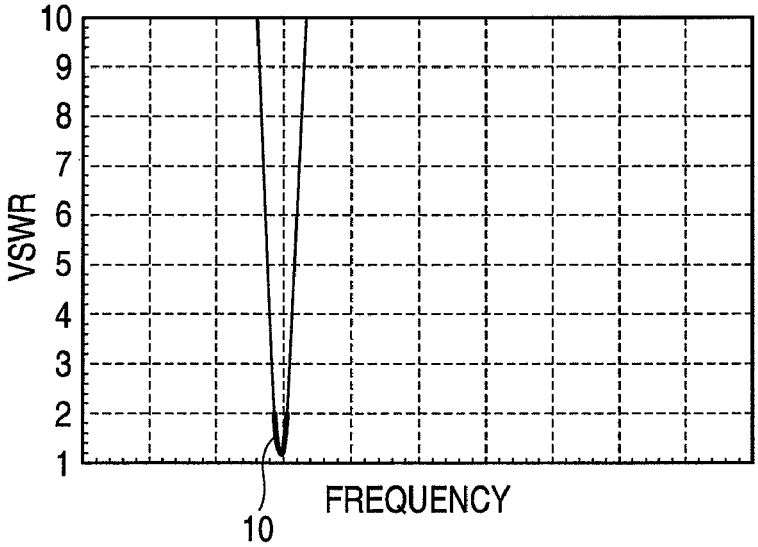

In FIGS. 5A, 5B and 5C, reference numeral 1 designates the loop antenna, reference numeral 2 designates the conductor, reference numeral 3 designates the ground conductor, reference numeral 4 designates the dielectric substrate and reference numeral 5 designates the transmitter-receiver 5. In the fifth embodiment, a configuration in which the loop antenna 1, the ground conductor 3 and the conductor 2 are formed on respective layers of the dielectric substrates, and the layers are laminated is shown. Operation is the same as the first embodiment.

As described thus far, even when the configuration of a single layer dielectric substrate is not possible due to the limitation of component mounting, the flexibility in configuration may be may be enhanced by the laminated configuration. Even in the case of the laminated configuration, the same effects as in the first to the fourth embodiments are obtained.

Various modifications and alterations of this invention will be apparent to those skilled in the art without departing from the scope and sprit of this invention, and it should be understood that this is not limited to the illustrative embodiments set forth herein.

What is claimed is:

1. An antenna apparatus comprising:

a dielectric substrate having a first face as one of faces thereof and a second face on the opposite side from the one face as the other face thereof;

a ground conductor which constitutes a bottom board formed on the first face;

a loop antenna provided in the vicinity of the circumference of the ground conductor, the loop antenna having a wavelength shorter than that of a frequency band to be used and having matching circuits connected to both ends thereof;

a power dispatching unit formed at one end of the matching circuit for transmitting and receiving signals; and a conductor being provided on the second face and having a wavelength shorter than that of the frequency band to be used, the conductor having matching circuits connected respectively to both ends thereof so as to be electromagnetically coupled and resonant with the loop antenna.

2. An antenna apparatus comprising:

a dielectric substrate having a first face as one of faces thereof and a second face on the opposite side from the one face as the other face thereof;

a ground conductor which constitutes a bottom board formed on the first face;

a loop antenna provided in the vicinity of the circumference of the ground conductor, the loop antenna having a wavelength shorter than that of a frequency band to be used and having matching circuits connected respectively to both ends thereof;

a power dispatching unit formed at one end of the matching circuit for transmitting and receiving signals; and a plurality of conductors being arranged on the second face and having a wavelength shorter than that of the frequency band to be used, the conductors having matching circuits connected respectively to both ends thereof so as to be electromagnetically coupled and resonant with the loop antenna.

3. The antenna apparatus according to claim 1, further comprising a terminating resistance at one of the matching circuits connected respectively to both ends of the loop antenna and the conductor.

4. The antenna apparatus according to claim 2, further comprising a terminating resistance at one of the matching circuits connected respectively to both ends of the loop antenna and the conductor.

5. The antenna apparatus according to claim 1, further comprising a ground conductor formed on at least part of a portion of the second face as the other face of the dielectric substrate opposing the ground conductor formed on the first face, wherein the ground conductor formed on the first face and the ground conductor formed on the second face are connected in conduction via a through hole.

6. The antenna apparatus according to claim 2, further comprising a ground conductor formed on at least part of a portion of the second face as the other face of the dielectric substrate opposing the ground conductor formed on the first face, wherein the ground conductor formed on the first face and the ground conductor formed on the second face are connected in conduction via a through hole.

7. The antenna apparatus according to claim 3, further comprising a ground conductor formed on at least part of a portion of the second face as the other face of the dielectric substrate opposing the ground conductor formed on the first face, wherein the ground conductor formed on the first face and the ground conductor formed on the second face are connected in conduction via a through hole.

8. The antenna apparatus according to claim 4, further comprising a ground conductor formed on at least part of a portion of the second face as the other face of the dielectric substrate opposing the ground conductor formed on the first face, wherein the ground conductor formed on the first face and the ground conductor formed on the second face are connected in conduction via a through hole.

9. The antenna apparatus according to claim 1, wherein at least the loop antenna, the conductor and the ground conductor are formed on a plurality of the dielectric substrates and the plurality of the dielectric substrates are laminated.

10. The antenna apparatus according to claim 2, wherein at least the loop antenna, the conductor and the ground conductor are formed on a plurality of the dielectric substrates and the plurality of the dielectric substrates are laminated.

11. The antenna apparatus according to claim 3, wherein at least the loop antenna, the conductor and the ground conductor are formed on a plurality of the dielectric substrates and the plurality of the dielectric substrates are laminated.

12. The antenna apparatus according to claim 4, wherein at least the loop antenna, the conductor and the ground conductor are found on a plurality of the dielectric substrates and the plurality of the dielectric substrates are laminated.

13. The antenna apparatus according to claim 5, wherein at least the loop antenna, the conductor and the ground conductor are formed on a plurality of the dielectric substrates and the plurality of the dielectric substrates are laminated.

14. The antenna apparatus according to claim 6, wherein at least the loop antenna, the conductor and the ground conductor are formed on a plurality of the dielectric substrates and the plurality of the dielectric substrates are laminated.

15. The antenna apparatus according to claim 7, wherein at least the loop antenna, the conductor and the ground conductor are formed on a plurality of the dielectric substrates and the plurality of the dielectric substrates are laminated.

16. The antenna apparatus according to claim 8, wherein at least the loop antenna, the conductor and the ground conductor are formed on a plurality of the dielectric substrates and the plurality of the dielectric substrates are laminated.

* * * * *